United States Patent [19]

Heckenkamp

[11] Patent Number: 5,019,676

[45] Date of Patent: May 28, 1991

[54] AUXILIARY OPERATOR FOR CIRCUIT INTERRUPTING APPARATUS WITH INTERLOCK BETWEEN SWITCH AND HOUSING

[75] Inventor: Daniel P. Heckenkamp, Sussex, Wis.

[73] Assignee: Eaton Corporation, Cleveland, Ohio

[21] Appl. No.: 525,803

[22] Filed: May 21, 1990

[51] Int. Cl.[5] ..... H01H 9/22

[52] U.S. Cl. ..... 200/50 A

[58] Field of Search ..... 200/50 A, 50 AA, 330; 361/337, 339, 343, 344

[56] References Cited

U.S. PATENT DOCUMENTS

| | | | |
|---|---|---|---|
| 4,034,169 | 7/1977 | Armstrong et al. | 200/50 A |
| 4,074,091 | 2/1978 | Bischaf et al. | 200/50 A |
| 4,760,220 | 7/1988 | Fritsch et al. | 200/50 A |
| 4,789,919 | 12/1988 | Cox et al. | 361/344 X |

*Primary Examiner*—J. R. Scott

*Attorney, Agent, or Firm*—L. G. Vande Zande

[57] ABSTRACT

A removable control unit of a motor control center has an auxiliary operator handle linked to a molded case circuit breaker handle for control of the circuit breaker externally of the motor control center cabinet. An interlock slide bar is driven by the auxiliary handle to an extended position to block removal of the unit with the circuit breaker in the ON condition, and follows the handle by gravitational force to a withdrawn position upon movement of the handle to an OFF condition of the circuit breaker, the slide bar abutting a fixed stop prior to the handle reaching the OFF condition to separate the handle from the slide bar in the OFF condition. A spring carried on the interlock slide bar is engaged by the handle to effect driving engagement, compression of the spring occurring only as the handle is nearly in the ON condition.

18 Claims, 2 Drawing Sheets

26e
26d
54
54b
54c
66
32c
32a
58
56
70
26
54a
26f
56a 26a
22a
40
54
54a
66
26f
56
60
64
70
62
22a
22
26
26c
34
38
26b
28
32a
58

AUXILIARY OPERATOR FOR CIRCUIT INTERRUPTING APPARATUS WITH INTERLOCK BETWEEN SWITCH AND HOUSING

BACKGROUND OF THE INVENTION

This invention relates to auxiliary operator mechanisms utilized on removable control units of a motor control center of the type disclosed in U.S. Pat. No. 4,760,220 issued July 26, 1988 to Ronald J. Fritsch and Francis A. Lubinski, and assigned to the assignee of this application, which patent is hereby incorporated herein by reference. More particularly, this invention relates to an improved drive connection between a handle assembly and a unit interlock slide bar of the auxiliary operator mechanism.

Motor control centers comprise a cabinet having a plurality of vertically arranged compartments which open to a front face of the cabinet. Removable control units are individually contained within respective compartments to be slidably withdrawn through the front opening. Each removable control unit comprises a frame to which motor control apparatus such as contactors, overload relays, fuse blocks, disconnect switches, molded case circuit breakers or motor circuit protectors or combinations of the foregoing are mounted. An operator mechanism is also mounted to the removable control unit for operating the circuit interrupting apparatus of the control unit such as the disconnect switch, molded case circuit breaker or the motor circuit protector. The molded case circuit breaker and the motor circuit protector each have self contained handles and operator mechanisms. Therefore, the operator mechanism of the motor control unit functions as an auxiliary operator for these devices.

The auxiliary operator also functions to operate a unit interlock member which extends to a position of interference with stationary framework of the cabinet in an ON condition of the circuit interrupting apparatus to prevent withdrawal of the removable control unit while the apparatus is electrically live. In an OFF position of the circuit interrupting apparatus and of the auxiliary operator, the unit interlock member assumes a withdrawn position out of interference with the cabinet framework.

The self contained operator handle of molded case circuit breakers or motor circuit protectors assumes one of four positions, i.e. ON, OFF, TRIP and RESET. Through linkage that interconnects the auxiliary operator handle with the circuit interrupting apparatus operator handle, the handle of the auxiliary operator also assumes one of four positions corresponding to the aforementioned ON, OFF, TRIP and RESET positions of the circuit interrupting apparatus handle. In prior art auxiliary operator assemblies, e.g. that of the above referenced patent, the interlock member is a slide bar which is spring biased to an extended position and is driven to a withdrawn position by the auxiliary operator handle when moving to the OFF position, compressing the spring that provides the aforementioned bias to the slide bar. While it is desirable to have the interlock slide bar biased to its extended position unless specifically withdrawn by operating the apparatus to an OFF condition, it has been found that the spring can introduce certain problems with regard to position of either handle. For example, when the auxiliary operator handle is moved to the OFF position and therefore moves the circuit interrupting apparatus handle to the OFF position, the auxiliary operator handle drives the interlock slide bar to a withdrawn position which compresses the interlock slide bar bias spring. Due to tolerances in the auxiliary operator, circuit interrupting apparatus handle/operator and in the interconnecting linkage, the bias provided by the spring of the interlock slide bar may move the auxiliary operator handle upward from a true OFF position sufficiently to permit the interlock slide to bar extend to an interference position, blocking withdrawal of the removable control unit from the motor control center cabinet, necessitating the workman to hold the handle down while attempting to withdraw the control unit. Moreover, when resetting the circuit interrupting apparatus, the handle is moved beyond the OFF position to a RESET position. In so doing, the auxiliary operator handle compresses the interlock slide bar spring further, potentially to a solid condition under adverse tolerance conditions. If compressed solid, the interlock slide bar spring can prevent the auxiliary operator handle from moving fully to the RESET position and therefore prevent resetting of the circuit interrupting apparatus. Although prior art operator mechanisms have adjustment features built in, the effective adjustment range is often quite small and adjustment becomes difficult.

SUMMARY OF THE INVENTION

This invention provides an auxiliary operator for circuit interrupting apparatus of a motor control center wherein the operator handle is free of the unit interlock member in the OFF position of the handle and the circuit interrupting apparatus whereby the auxiliary operator handle is not influenced by a biasing means for the unit interlock member. The auxiliary operator handle drivingly engages a spring or an equivalent resilient portion of the unit interlock member during movement from OFF to ON positions, compressing the spring or other resilient member in a late portion of the movement as the handle nears the ON position whereby the spring or resilient member of the unit interlock provides minimum adverse bias to the operator mechanism. The unit interlock abuts a fixed stop to determine its withdrawn position as the operator handle moves to the OFF position, thereby moving free of the unit interlock member in the OFF position and in continued movement to a RESET position.

The invention and its advantages will become more readily apparent when reading the following description and claims in conjunction with the accompanying drawings.

DETAILED DESCRIPTION OF THE PREFERRED EMBODIMENT

Figure 2:
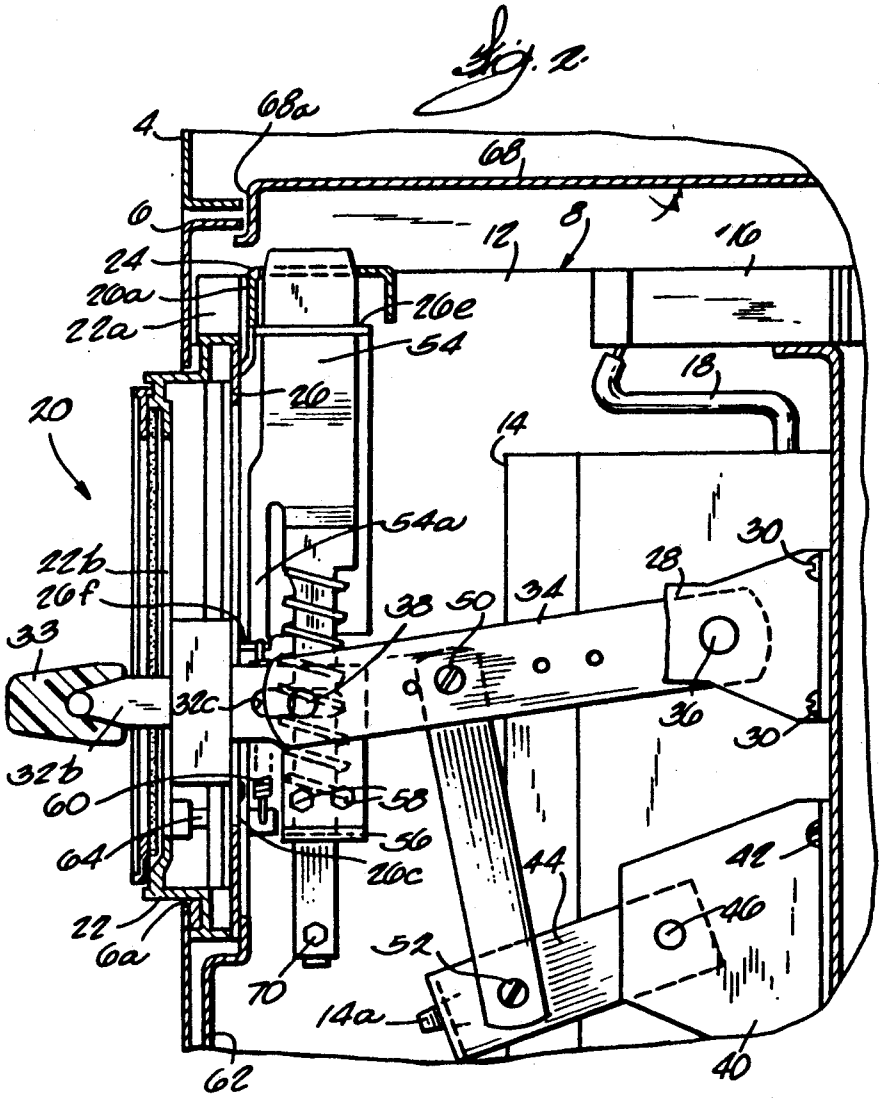
FIG. 2 is a view similar to FIG. 1 but showing the auxiliary operator handle and circuit interrupter apparatus in an OFF position and showing a unit interlock member against a fixed stop defining a withdrawn position thereof.

A motor control center comprises a cabinet having a plurality of compartments open to the front of the cabinet, which compartments are closed by respective doors such as 4 and 6 shown in the drawings which are hinged to the cabinet, usually along a side edge of the respective doors. Each compartment has a removable control unit 8 slidably mounted therein through the open front when the respective door is open. A removable control unit comprises a rear panel 10 and pair of side panels 12 (only one of which is shown. Circuit interrupting apparatus such as a molded case circuit breaker 14 or a nearly identical motor circuit protector is mounted to the rear panel 10 by suitable means (not shown). A plug-on connector module 16 for the removable control unit 8 is attached to rear panel 10. While not specifically shown herein, connector module 16 has a plurality of plug-in connectors which engage with bus bars within the motor control center cabinet to provide electrical power to the removable control unit 8 when the same is fully inserted within the respective compartment. Preformed insulated connector straps 18 (only one shown) are bolted to respective terminals of connector module 16 and the circuit interrupting apparatus 14 to supply power to the circuit interrupting apparatus.

Figure 1:
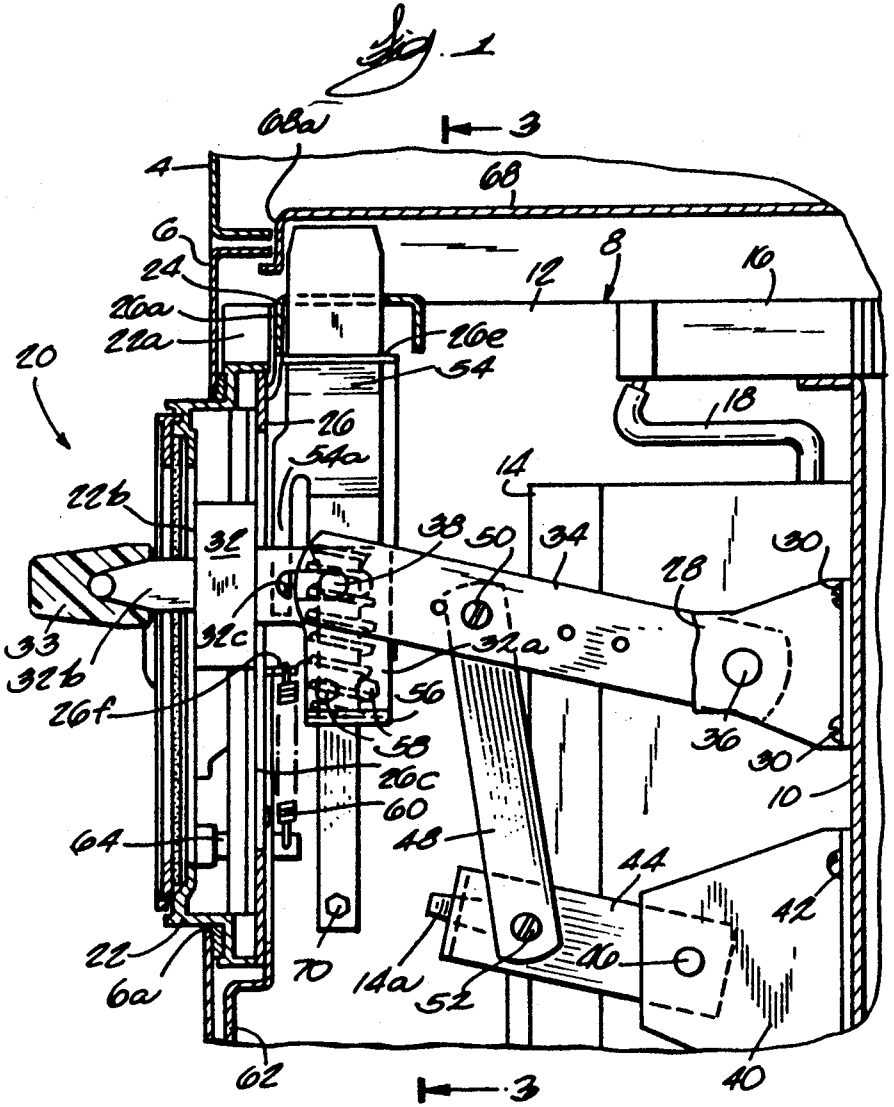
FIG. 1 is a cross sectional view of the auxiliary operator of this invention and of fragmentary portions of a motor control center cabinet and a removable control unit, showing the auxiliary operator and the circuit interrupting apparatus in an ON position.
Figure 3:
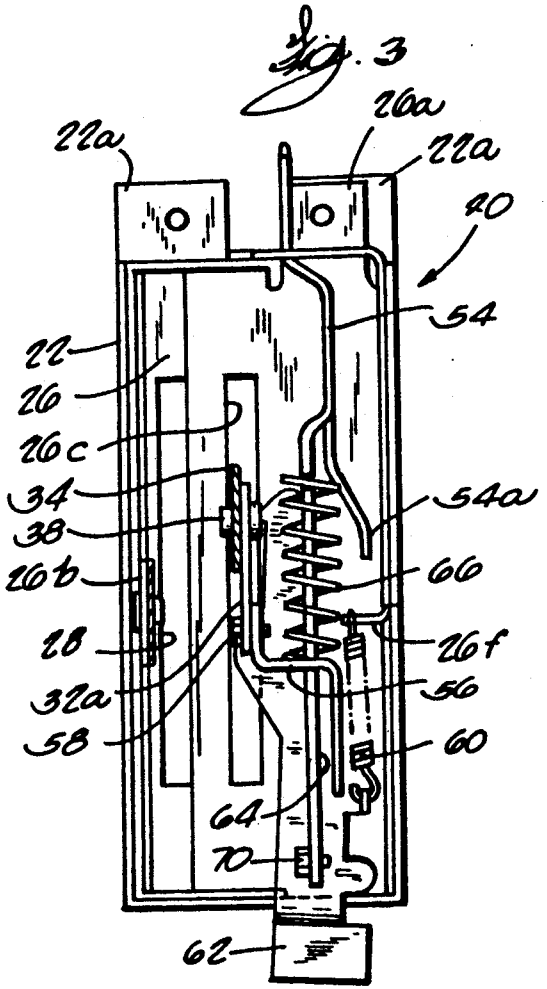
FIG. 3 is a rear view of the auxiliary operator assembly taken along the line 3—3 in FIG. 1.

The auxiliary operator 20 of this invention comprises a molded housing 22 which has a pair of upwardly projecting tabs **22*a* at its upper end (FIG. 3). Each of the tabs 22*a* are provided with a central hole through which screws (not shown) or other suitable fastening means may be inserted to be cooperably received within aligned holes in an inverted U-shaped channel 24 secured between the side walls 12 of the removable control unit near its upper forward end. Auxiliary operator 20 also comprises a lower support plate 26 which is attached to the rear of molded housing 22 by suitable means (not shown). Support plate 26 has a tab 26*a* projecting from the upper end thereof which is aligned with one tab 22*a* of housing 22 and is disposed between that tab 22*a* and channel 24. A second tab 26*b* extends rearwardly along an edge of the operator mechanism 20 (FIG. 3). A brace 28 is attached to the rear panel 10 by a pair of screws 30. Although only fragmentally shown in FIGS. 1 and 2, brace 28 extends forwardly to overlap the tab 26*b*. A hole is provided in the end of brace 28 which aligns with the hole in tab 26*b* and the two members are firmly secured together by a rivet or other suitable fastener which extends through the aligned openings. Thus the operator 20 is mounted to the removable control unit 8 at the forward edge thereof. The doors, e.g. 6, are provided with openings, e.g. 6*a*, which surround a forwardly extending bezel of the housing 22** when the respective doors are closed to afford exterior accessibility of the auxiliary operator.

An operator handle 32 is supported for sliding movement on support plate 26, the handle comprising a drive leg **32*a* which projects rearwardly through a slot 26*c* in support plate 26. A forwardly extending leg 32*b* of handle 32 projects through an elongated slot 22*b* in housing 22 and has an operator knob 33 attached to the outermost end thereof. Auxiliary operator 20 is oriented such that linear sliding movement of handle 32** occurs in a vertical direction for reasons that will be discussed hereinafter.

A drive lever 34 is pivotally mounted on brace 24 at the base thereof by a shouldered rivet 36. The forward extending end of drive lever 34 is disposed against an outer surface of drive leg **32*a* of handle 32. Drive leg 32*a* has a slot 32*c* elongated in a direction perpendicular to the direction of linear sliding movement of the handle 32. A rivet 38 extends through a hole of drive lever 34 and through the slot 32*c* to form a hinged connection between drive lever 34 and drive leg 32*a*. Thus, as handle 32 is slid linearly reciprocably along support plate 26, the drive lever 34 is pivoted about rivet 36 by the hinge connection provided by rivet 38, the later translating forward and rearward within the elongated slot 32*c* as the drive lever 34 moves over center of the rear pivot at rivet 36**.

A bracket 40 is mounted to rear panel 10 of the removable control unit 8 by screws 42. While not shown in the drawings, a similar bracket may be mounted at the opposite side of the circuit breaker 14. A U-shaped yoke 44 is pivotally mounted between the support brackets 40 by rivets 46. The bight portion of yoke 44 has an opening therein which surrounds an operating handle **14*a* of circuit breaker 14. A link member 48 is pivotally connected to drive lever 34 by a shouldered screw 50 and to yoke 48 by a shouldered screw 52. Thus, pivotal movement of drive lever 34 in response to linear sliding movement of handle 32 is transferred to yoke 44 for movement to and fro about rivet 46 through the driving connection of link 48, thereby operating the circuit breaker 14 between ON and OFF positions in a substantially concentric manner with the pivot of handle 14*a***.

Figure 4:
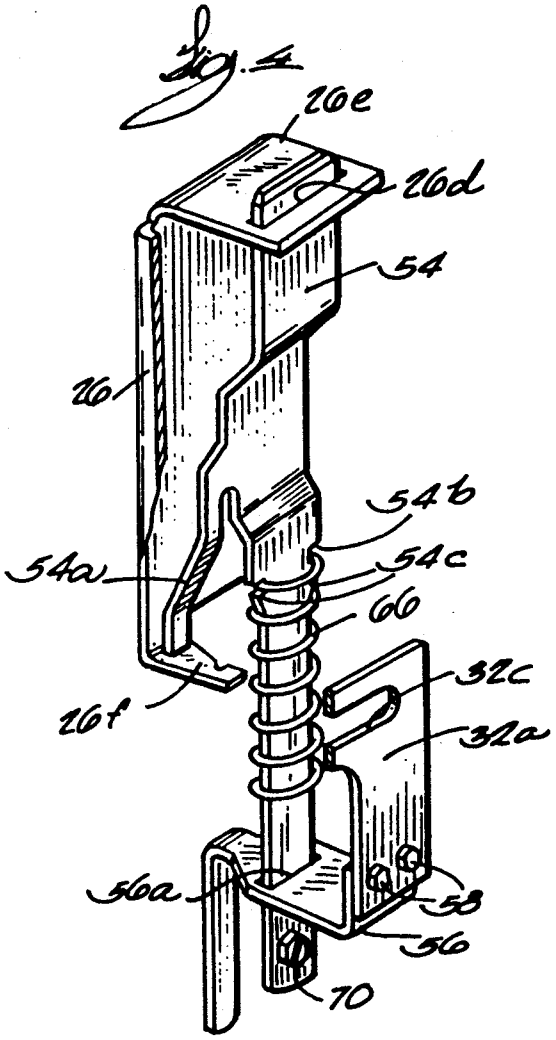
FIG. 4 is a perspective view of the unit interlock member, a fragmentary portion of the handle member and a fragmentary portion of a support plate of the auxiliary operator providing a fixed stop for the unit interlock member.

A unit interlock which functions to prevent insertion or withdrawal of the removable control unit while the circuit interrupting apparatus 14 is in an ON condition is incorporated in the auxiliary operator 20. The unit interlock preferably comprises a slide bar 54 which extends through a slot **26*d* in a rearward extension 26*e* of support plate 26 as seen best in FIG. 4. The lower end of slide bar 54 extends through a slot 56*a* in a drive bracket 56 which is attached to drive leg 32*a* of handle 32 by screws 58. It will be appreciated that drive bracket 56 guides the lower end of slide bar 54 for sliding movement while itself sliding as handle 32 is moved. An offset arm 54*a* extends from the slide bar 54 near its central section to overlie and rest upon an offset finger 26*f* of support plate 26 as best seen in FIG. 4. Finger 26*f* serves as an anchor for a helical tension spring 60 which biases a door interlock lever 62 counterclockwise about a pivot 64 as seen in FIG. 3. The lowermost or withdrawn position of slide bar 54 with respect to the support plate 26 and housing 22 of the auxiliary operator 20 is determined by the abutment of the distal end of arm 54*a* against the surface of finger 26*f*. A helical compression spring 66 is disposed over the lower end of slide bar 54. The upper end of spring 66 is trapped against a shoulder 54*b* on slide bar 54 (FIG. 4) by sliding the uppermost loop of the spring over a pair of ears 54*c*** formed on the slide bar.

As seen best in FIGS. 2 and 4, when the handle 32 is moved to the OFF position of the circuit breaker 14, the drive bracket 56 moves away from the lower end of the spring 66 to fully disengage the handle 32 from a driving or biasing condition with respect to the unit interlock slide bar 54 or its spring 66. As the handle 32 is moved upward from the OFF position to the ON position, the upper surface of drive bracket 56 picks up the lower loop of spring 66 and drives slide bar 54 upwardly to an extended position wherein the upper end of slide bar 54 extends behind a flange 68*a* of a structural member 68 of the motor control center cabinet to block removal of the control unit 8 from the cabinet through the forward opening when door 6 is open. The travel of handle 32 is such that the handle is nearly in the ON position and the interlock slide bar 54 is in its extended position before drive bracket 56 begins to compress spring 66 to provide a bias to the interlock slide bar 54. In this way, the interlock member does have a bias to its extended position and the spring 66 affords a tolerance-compensating lost motion connection between the handle and the slide bar without providing adverse spring forces to the handle 32 and the linkage that joins handle 32 to the circuit breaker handle 14*a*. When the circuit breaker handle 14*a* is moved to the OFF position as shown in FIG. 2, the interconnecting linkage causes the handle 32 to assume a corresponding position which may be marked by suitable indicia on the front surface of the housing 22. Drive bracket 56 moves away from the lower end of spring 66 as the slide bar 54 stops against finger 26*f*, and therefore spring 66 provides no bias to handle 32 that would cause it to move from the OFF position.

The auxiliary operator 20 is oriented such that the sliding movement of the handle 32 and the unit interlock 54 are in a vertical direction. Therefore, the handle 32 has a gravitational bias downward to assume, through the interconnecting linkage, the position of the circuit breaker handle 14*a*, and interlock slide bar 54 is gravitationally biased to the withdrawn position wherein the distal end of arm 54*a* rests upon the upper surface of finger 26*f*. In the event that interlock slide bar 54 is pinched or wedged against a flange 68*a* or is otherwise hung up and does not return to the fixed STOP position by gravitational force, a screw 70 is threaded through a hole in the lower end of slide bar 54 to create an enlarged boss which will not pass through the slot 56*a* in drive bracket 56. If, when the handle 32 is moved from the ON position to the OFF position, the interlock slide bar 54 does not follow by gravity, the slide bar is directly driven by continued downward manual movement of handle 32 and the resulting movement of drive bracket 56 bearing upon screw 70. It will further be appreciated that the reset action of handle 32 for circuit breaker 14 requires handle movement further downward beyond the OFF position. In the arrangement provided by this invention, the handle 32 only moves further away from engagement with spring 66 when going toward the RESET position. Therefore, spring 66 does not interfere with movement of the auxiliary operator handle to the RESET position and resetting of the circuit breaker 14.

The foregoing describes a preferred embodiment of an auxiliary operator for circuit interrupting apparatus of a motor control center or the like. Although the auxiliary operator of this invention has been shown and described in a single preferred embodiment, it is to be understood that it is susceptible of various modifications without departing from the scope of the appended claims.

I claim:

1. An auxiliary operator for circuit interrupting apparatus contained in a removable unit of a motor control center cabinet, said auxiliary operator comprising:

a housing mounted on said removable unit;

a handle assembly guided for reciprocal movement in said housing;

linkage connected to said handle assembly and to circuit interrupting apparatus mounted in said unit, said apparatus being operated by appropriate movement of said handle assembly;

an interlock member movable relative to said handle assembly between a withdrawn position and an extended position, said interlock member abutting a stop fixed relative to said removable unit to define said withdrawn position and blocking removal of said unit from said cabinet by interference of said interlock member with a fixed portion of said cabinet in said extended position; and drive means on said handle assembly engaging said interlock member for movement thereof to said extended position upon movement of said handle assembly to an ON condition of said apparatus, and disengaging said interlock member upon movement of said handle assembly to an OFF condition of said apparatus.

2. An auxiliary operator as defined in claim 1 wherein said extended position of said interlock member is arranged substantially above said withdrawn position, said interlock member moving from said extended position to said withdrawn position by gravitational force.

3. An auxiliary operator as defined in claim 2 wherein said handle assembly drive means abuttingly engages means on said interlock member at an intermediate point in movement of said handle assembly from said OFF condition to said ON condition of said apparatus and directly drives said interlock member to said extended position upon continued movement of said handle assembly to said ON condition of said apparatus.

4. An auxiliary operator as defined in claim 3 wherein said drive means disengages said means on said interlock member at a point in movement of said handle assembly prior to reaching said OFF condition from said ON condition of said apparatus.

5. An auxiliary operator as defined in claim 4 wherein said means on said interlock member comprises resilient means partially compressed by said drive means when said handle assembly is in said ON condition of said apparatus, thereby resiliently maintaining said interlock member in said extended position.

6. An auxiliary operator as defined in claim 5 wherein said drive means moves away from said resilient means when said handle assembly is in said OFF condition of said apparatus, ensuring no bias is transferred from said resilient means to said handle assembly.

7. An auxiliary operator as defined in claim 3 further comprising second means on said interlock member abuttingly engaged by said drive means upon movement of said handle assembly in a direction from said ON condition toward said OFF condition, positively driving said interlock member to said withdrawn position in the event said interlock member does not return to said withdrawn position from said extended position by gravitational force.

8. An auxiliary operator as defined in claim 7 wherein said interlock member is slidably movable parallel to a direction of movement of said handle assembly.

9. An auxiliary operator as defined in claim 8 wherein said interlock member is guided for sliding movement by a fixed element of said housing at one point and by an element of said handle assembly at a second point.

10. An auxiliary operator as defined in claim 9 wherein said element of said handle assembly is disposed normal to said direction of movement of said handle assembly and comprises an aperture through which said interlock member is slidably disposed.

11. An auxiliary operator as defined in claim 10 wherein said element of said handle assembly comprises said drive means.

12. An auxiliary operator as defined in claim 11 wherein said means on said interlock member abuttingly engaged by said drive means comprises a helical spring disposed on interlock member having a major axis thereof extending in the direction of sliding movement of said interlock member, one end of said spring being affixed to said interlock member and an opposite end of said spring being abuttingly engaged by said element of said handle assembly in an area adjacent said aperture.

13. An auxiliary operator for circuit interrupting apparatus contained in a removable unit of a motor control center cabinet, said auxiliary operator comprising:

a housing mounted to said removable unit;

a handle assembly slidably mounted in said housing;

circuit interrupting apparatus mounted in said removable unit, said apparatus comprising a self-contained operator handle;

linkage connected to said handle assembly and to said apparatus operator handle for operation of said apparatus by appropriate movement of said handle assembly; and an interlock member driven to an extended position by said handle assembly upon movement thereof from an OFF condition to an ON condition of said apparatus, said interlock member blocking removal of said unit from said cabinet by interference of said interlock member with a fixed portion of said cabinet in said extended position, said interlock member moving to a withdrawn position abutting a stop fixed relative to said removable unit during movement of said handle assembly from said ON condition to said OFF condition of said apparatus, said handle assembly being disengaged from driving engagement with said interlock member during movement to said OFF condition of said apparatus.

14. An auxiliary operator as defined in claim 13 wherein said auxiliary operator is oriented for vertical movement of said handle assembly and said interlock member, said extended position of said interlock member being arranged above said withdrawn position thereof, and said interlock member is gravitationally biased to said withdrawn position from said extended position.

15. An auxiliary operator as defined in claim 14 wherein said interlock member comprises resilient means and said handle assembly comprises drive means engaging said resilient means during said movement of said handle assembly from said OFF to said ON condition for driving said interlock member to said extended position.

16. An auxiliary operator as defined in claim 15 wherein said resilient means comprises a helical spring disposed on said interlock member having a major axis of said spring disposed parallel to said movement of said interlock member, one end of said spring being attached to said interlock member and an opposite end of said spring being disposed for abutting engagement by said handle assembly drive means.

17. An auxiliary operator as defined in claim 16 wherein said interlock member comprises a slide bar guided for vertical sliding movement at one end by an element of said housing and guided for said vertical sliding movement at an opposite end by an element of said handle assembly.

18. An auxiliary operator as defined in claim 17 wherein said element of said handle assembly comprises said drive means abuttingly engaging said opposite end of said spring for said driving engagement with said interlock slide bar at a location between between said extended and said withdrawn positions of said interlock member during movement of said handle assembly from said OFF to said ON condition, and wherein said element of said handle assembly separates from said opposite end of said spring during movement of said handle assembly to said OFF condition after said interlock slide bar abuts said fixed stop at said withdrawn position.

* * * * *